US005165814A

United States Patent [19]

Buda

[11] Patent Number: 5,165,814

[45] Date of Patent: Nov. 24, 1992

[54] VIBRATING WRITING INSTRUMENT

[76] Inventor: Donita Buda, 1201 Seafarer Cir. #103, Jupiter, Fla. 33477

[21] Appl. No.: 821,578

[22] Filed: Jan. 16, 1992

[51] Int. Cl.[5] ..... B43K 29/00; A61H 1/00

[52] U.S. Cl. ..... 401/195; 401/52; 128/41

[58] Field of Search ..... 401/195, 52; 128/36, 128/41, 43

[56] References Cited

U.S. PATENT DOCUMENTS

| | | | |
|---|---|---|---|
| 1,032,840 | 7/1912 | Keough | 128/41 X |
| 1,999,795 | 4/1935 | Wright | 128/41 X |
| 2,022,457 | 11/1935 | Brown | 128/41 X |
| 3,390,460 | 7/1968 | Brown | 401/195 X |
| 4,037,283 | 7/1977 | Moisiuk | 401/195 X |
| 4,599,799 | 7/1986 | Lopez | 33/18.1 |
| 4,643,207 | 2/1987 | Grahame | 132/73.6 |

*Primary Examiner*—Danton D. DeMille
*Attorney, Agent, or Firm*—Terry M. Gernstein

[57] ABSTRACT

A writing instrument, such as a ball point pen, includes a vibrating relay mechanism that includes a relay arm that moves between a first position abutting a housing and a second position spaced from the housing. When the arm moves into the first position, the impact between the arm and the housing sends a shock that is transferred to the user to relieve the tension associated with writer's cramp. A control mechanism controls the cyclical operation of the vibrating relay arm, and a power source includes a battery stored in the housing.

8 Claims, 8 Drawing Sheets

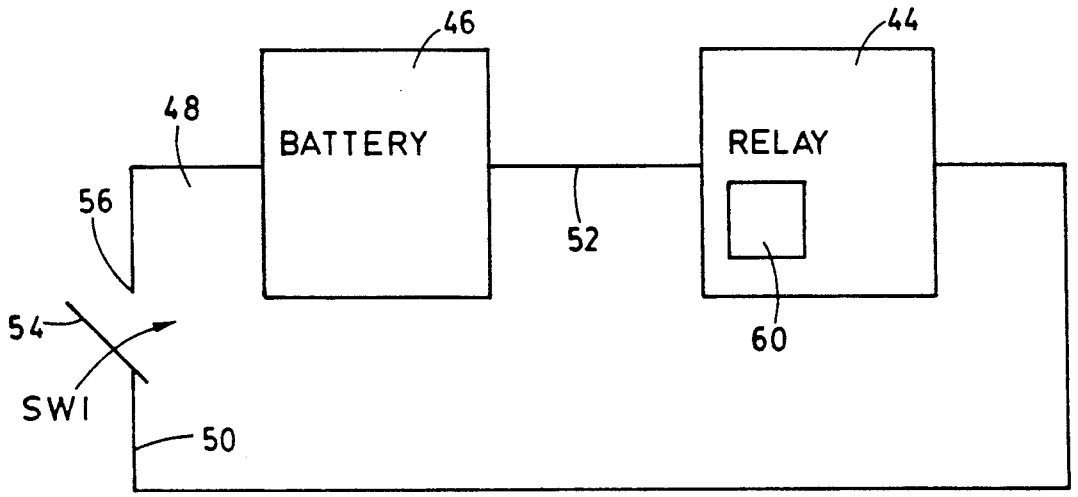
FIG. 4
FIG. 8
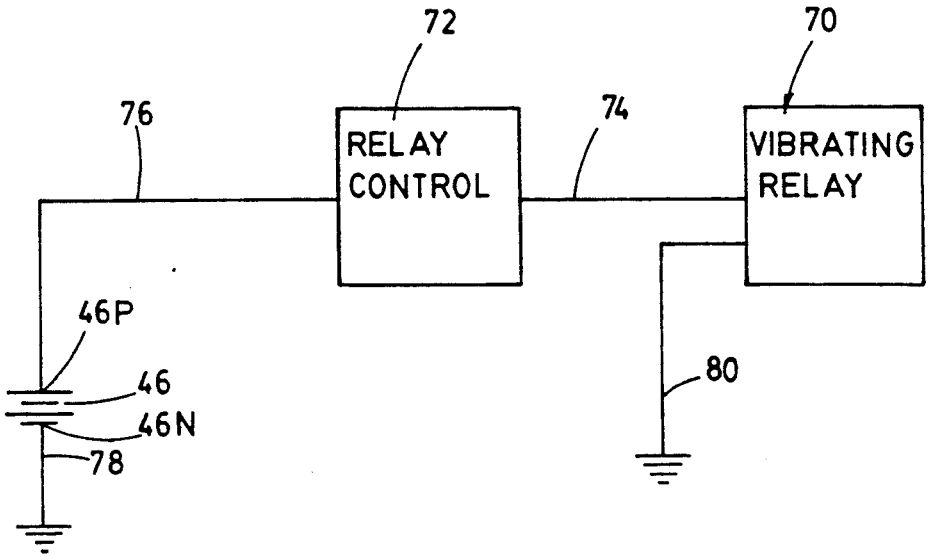

VIBRATING WRITING INSTRUMENT

TECHNICAL FIELD OF THE INVENTION

The present invention relates to the general art of writing instruments, and to the particular field of accessories for writing instruments.

BACKGROUND OF THE INVENTION

Many people suffer from what is generically termed "writer's cramp." For most people, this ailment arises after long periods of writing, or from writing in cramped positions. It also arises quickly in people who have arthritis or other such problems with their hands.

Many writing instruments are shaped to alleviate writer's cramp, such as having special barrels or the like. Some instruments even are oversized to account for this problem. The art also includes special accessories, such as finger grips that fit over the writing instrument.

While many of these solutions are helpful, they all have drawbacks that prevent them from being fully effective. In particular, many people have specific needs for comfort in a writing instrument. These requirements vary between individuals, and between situations for one individual. The above-mentioned instruments do not account for an individual's particular needs for comfort. Therefore, while these instruments may be effective for some people in some situations, they cannot be modified or adapted by an individual to meet his or her particular needs for a particular situation.

Therefore, there is a need for a writing instrument that can reduce the effects of writer's cramp based on the particular needs of each individual in a particular situation.

OBJECTS OF THE INVENTION

It is a main object of the present invention to provide a writing instrument that is comfortable to use.

It is another object of the present invention to provide a writing instrument that can be used for long periods of time without undue fatigue.

It is another object of the present invention to provide a writing instrument that can be used by people with arthritis.

It is another object of the present invention to provide a writing instrument that can be used for long periods of time without undue fatigue and which can be adjusted to fit the particular needs of the individual user for the particular job being performed.

SUMMARY OF THE INVENTION

These, and other, objects are achieved by a writing instrument that gently vibrates during its use. The vibration is transferred to the user's hand and serves to relieve the effects of writer's cramp. The vibration can be adjusted by the user to fit the situation and his or her needs. Thus, for example, one user may desire rapid vibrations and another may desire slow vibrations. Long periods of use may require slow or even intermittent vibrations, whereas, short uses may have rapid vibrations as the most effective way to relieve writer's cramp.

In particular, the instrument embodying the present invention includes a relay having an arm that moves between a first arm position abutting the writing instrument housing and a second arm position spaced from that housing. When the arm moves into the first arm position, it will impact the housing sending a small shock to the writer's hand. The relay is connected to a relay control that causes the arm to cycle between the two arm positions. The relay control can be adjusted to adjust the cycle of the arm thereby adjusting the amount of vibration felt by the writer.

In this manner, each individual writer can adjust the amount of vibration to fit his or her needs for the particular writing situation.

BRIEF DESCRIPTION OF THE DRAWING FIGURES

FIG. 4 illustrates the circuit connection of the vibrating means used by the writing instrument shown in FIG. 3.

FIG. 8 is a diagram of a circuit used in the second form of the writing instrument.

DETAILED DESCRIPTION OF THE PREFERRED EMBODIMENT OF THE INVENTION

Figure 1:
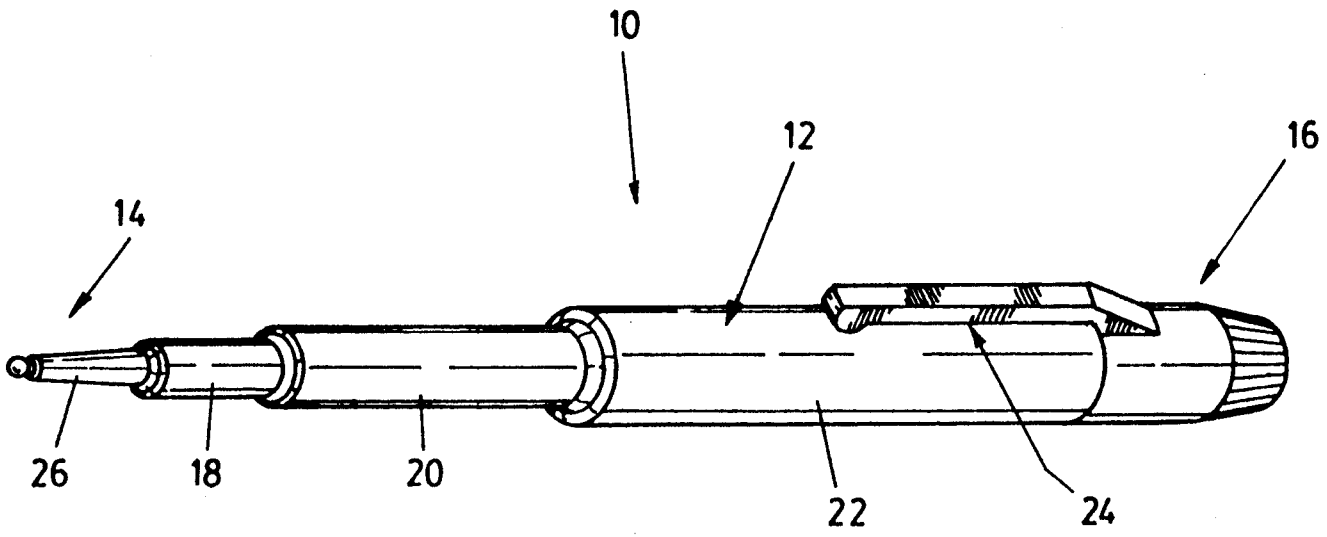
FIG. 1 is a perspective view of a writing instrument embodying the teaching of the present invention.
Figure 2:
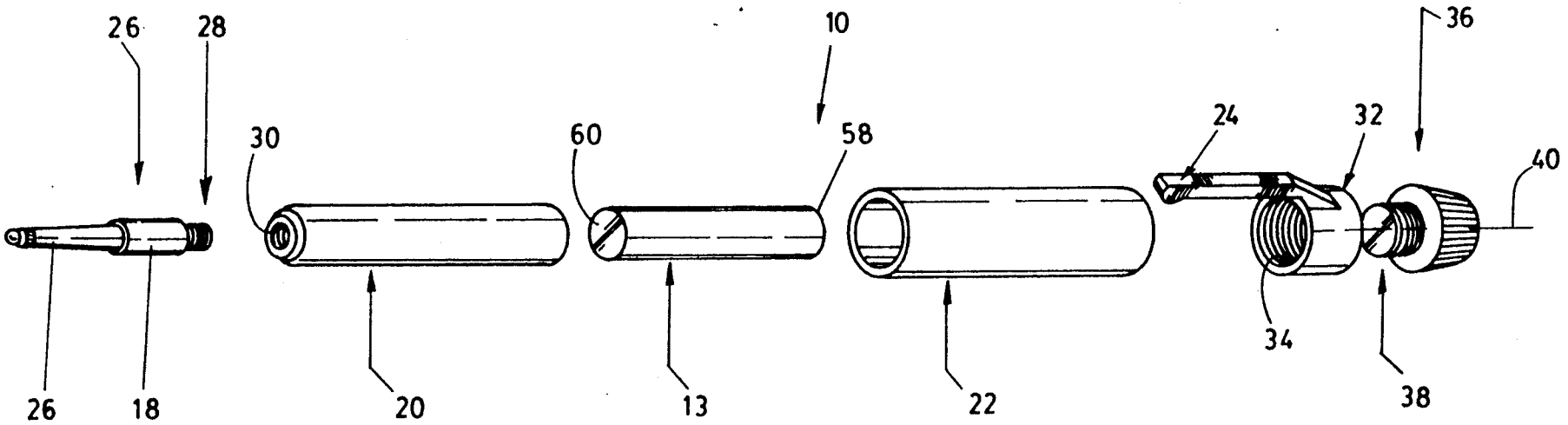
FIG. 2 is an exploded perspective view of the writing instrument shown in FIG. 1.

Shown in FIGS. 1 and 2 is a vibrating writing instrument 10 embodying the present invention. The writing instrument is shown as a pen, but could be a pencil or any other form of writing instrument, with the pen being chosen for the sake of convenience.

The instrument 10 includes a housing 12 having a writing tip end 14 and a rear end 16. The housing 12 includes a plurality of telescopingly connected sections 18, 20 and 22, with section 22 having a pocket clip 24 thereon. A writing tip 26 is positioned on section 18, and section 18 includes a screw thread 28 that matingly engages an internal screw thread 30 on section 20 to hold the writing tip in place on the section 20. The section 20 is connected to the section 22 by a slip fit or by a screw thread connection, with the slip fit being preferred. The section 22 is connected to a ring 32 by a screw threaded connection having a screw thread on the section 22 matingly engaging a screw thread 34 on the ring. A top cap 36 includes an external screw thread 38 that matingly engages an internal screw thread on the ring 34. The top cap in the instrument 10 is rotated about its longitudinal centerline 40 to operate the vibrating mechanism of the instrument as will be understood from the discussion presented below.

The writing tip 26 can be permanently extended or retractable as suitable, and a cover (not shown) can be used in conjunction with the writing instrument to enclose the writing tip when the instrument is not in use.

Figure 3:
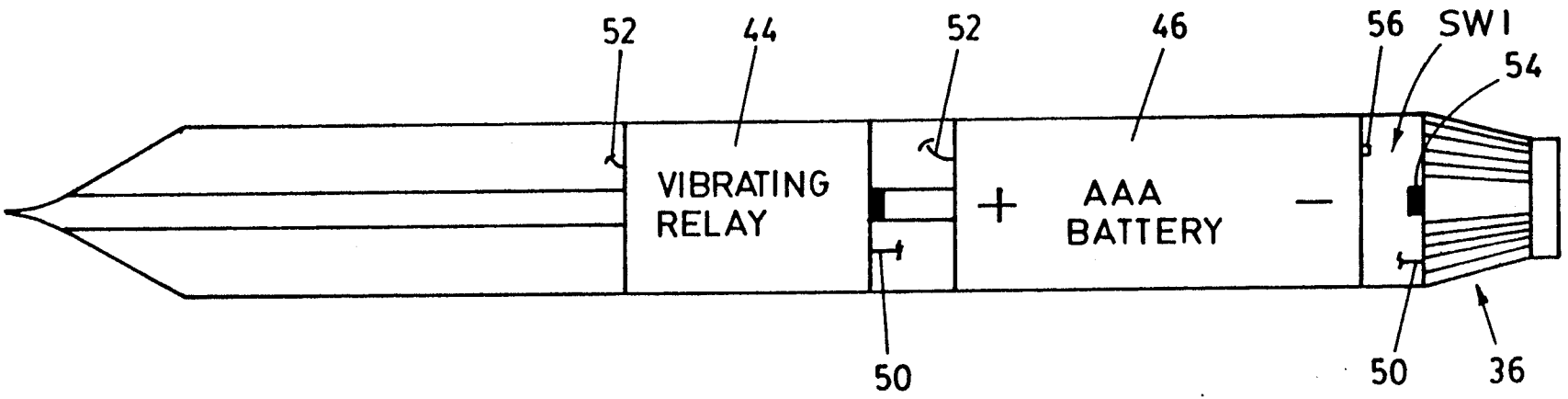
FIG. 3 is a cutaway side elevational view showing the vibrating relay and the battery in place inside the housing of the writing instrument.
Figure 5:
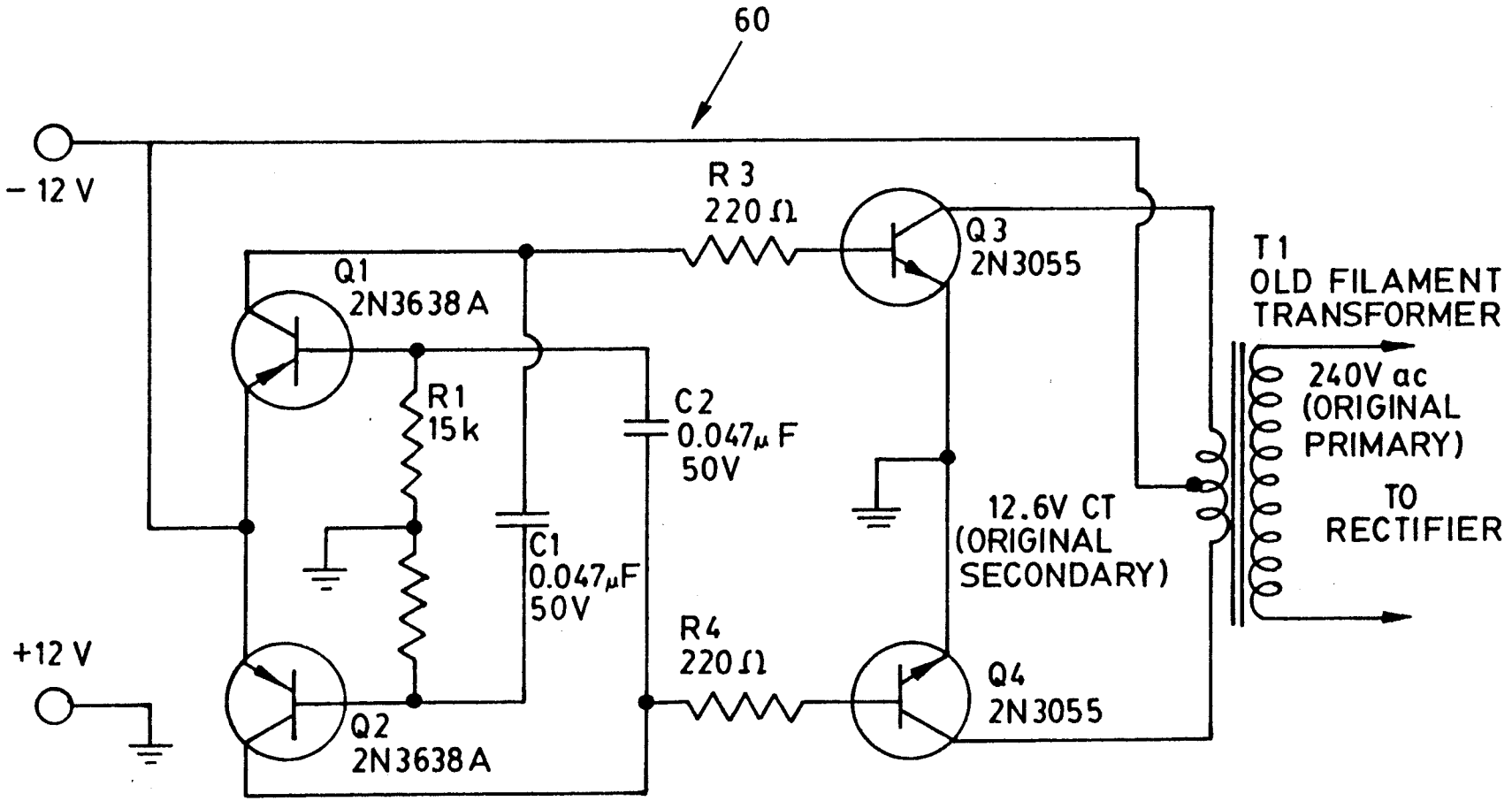
FIG. 5 illustrates a circuit for converting power from the battery into a form usable by the vibrating mechanism of the writing instrument.
Figure 6:
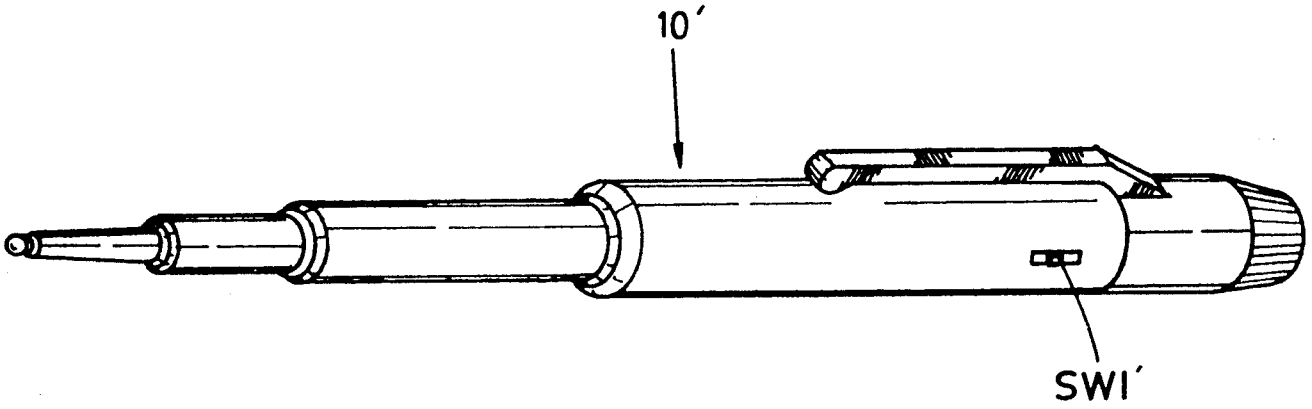
FIG. 6 is a perspective view of a second form of the writing instrument of the present invention.
Figure 7:
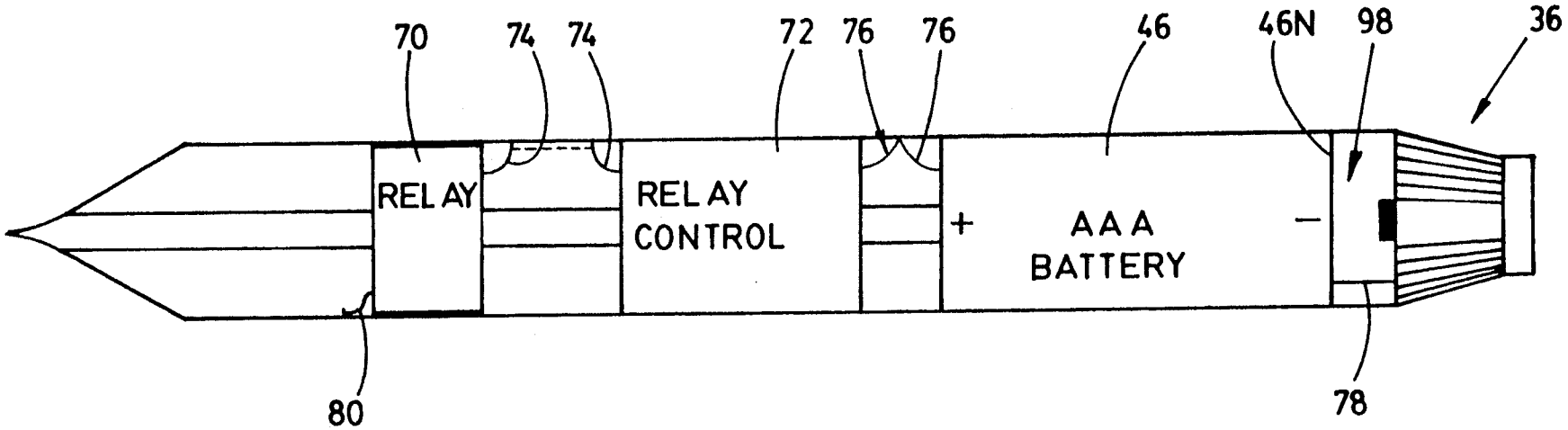
FIG. 7 is a cutaway elevational view of the second form of the writing instrument.

As indicated in FIGS. 3 through 5, the instrument 10 includes a vibrating relay mechanism 44. The relay mechanism is used to create a vibration of the housing adjacent to the user's hand. These vibrations will alleviate the tension in the user's hand to relieve the effects of writer's cramp. The relay mechanism is driven by a power supply 46, such as battery B connected to a lead line 48.

The form of the instrument shown in FIGS. 3 and 4 uses a single vibrating cycle. The circuit shown in FIG. 4 includes a switch SW1 connected to the battery by a lead line 48 and to the relay mechanism by a lead line 50. A lead line 52 connects the battery to the relay. The switch SW1 is controlled by the top cap 36. The top cap includes an electrically conductive projection 54 mounted thereon for movement therewith, and the battery has an electrically conductive projection 56 mounted thereon and corresponding to the lead line 48. The top cap is insulated to avoid shocking the user, and rotating the top cap will close the switch SW1 when the projections 54 and 56 are in electrical contact with each other. The top cap is shown in the switch-opening position in FIG. 3. Closing the switch SW1 completes the circuit shown in FIG. 4, and the relay will cycle.

The relay 44 includes circuit means 60 to convert the power received from the battery 46 into alternating current whereby the vibrating mechanism cycles. The circuit means 60 is schematically illustrated in FIG. 5. The circuit means 60 is a power amplifier driven by an astable multivibrator. Increasing the value of capacitors C1 and C2 will lower the frequency. The two transistors 03 and 04 are appropriately mounted.

A relay is connected to the circuit 60 and has an arm that vibrates as power is cycled through the relay. The cyclically operated arm abuts the housing and sends shocks to that housing. These shocks are felt by the user as vibrations that ease the tension in his or her hand during the writing operation.

If more control over the cyclic operation of the vibrating means is desired, the writing instrument 10' shown in FIGS. 6 through 10 is used. The instrument 10' includes a vibrating relay mechanism 70 connected to a relay control 72 by a lead line 74. A power source, such as source 46, has its positive side 46P connected to the relay control by a lead line 76. If necessary, a converter such as circuit 60 can be used to convert the power from the battery. The negative side 46N of the power source 46 is connected to ground by a lead line 78. The relay 70 is also connected to ground or to the negative side of the power source by a lead line 80.

Figure 9:
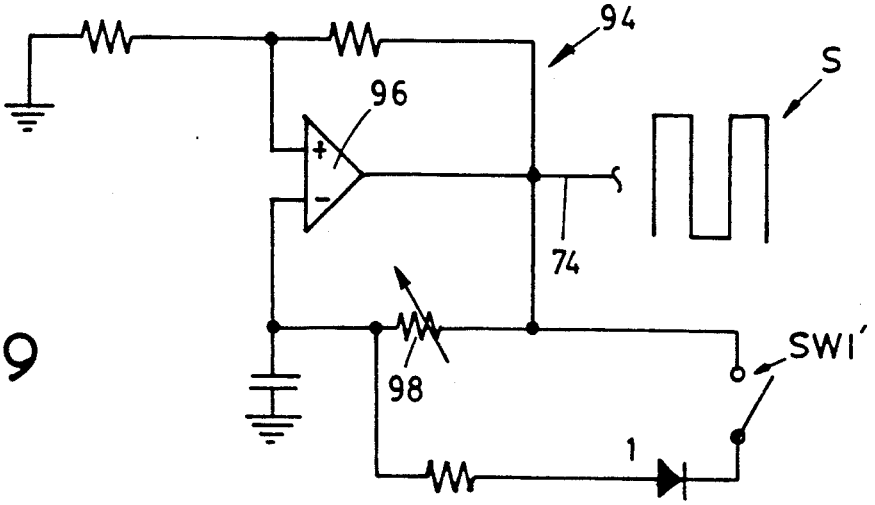
FIG. 9 is a diagram of circuit used to adjust the vibration cycle of the FIG. 6 writing instrument.
Figure 10:
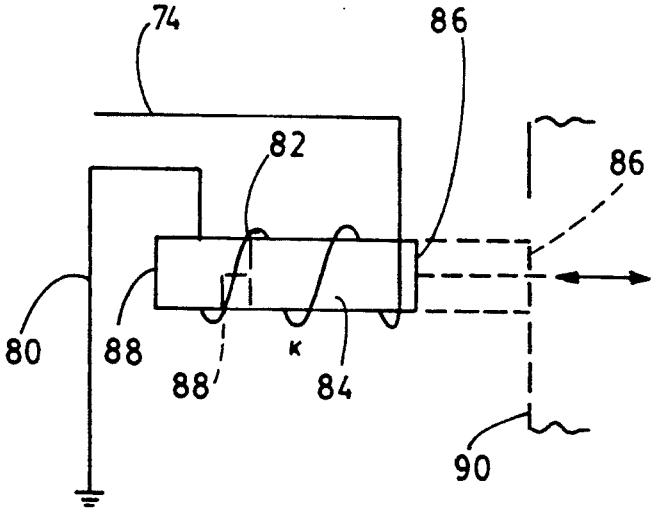
FIG. 10 is a relay that is coupled to the FIG. 6 circuit and which contact the housing to generate vibration that is transferred to the writer's hand.

As shown in FIGS. 9 and 10, the relay mechanism includes a coil 82 wrapped around an arm 84. The arm has a forward end 86 and a rear end 88 and moves between a first arm position shown in dotted lines in FIG. 10 with the forward end 86 in abutting contact with the inside surface 90 of the housing and a second arm position shown in full lines in FIG. 10 with the forward end 86 spaced from the housing. The contact between the arm and the wall sends a shock to the wall, and the shock is transmitted to the user.

The coil 82 has one end thereof connected to ground via the ground lead 80 and the other end connected to an oscillator circuit 94 via the lead 74. The cyclic operation of the relay is controlled by the circuit 94 and the cap 36. The circuit 94 has a Schmitt trigger and integrator built around an op-amp 96. Timing is controlled by the RC network, with resistor 98 being adjustable by movement of the cap 36. Voltage at the inverting input of the op-amp follows the RC charging exponential within the upper and lower hysteresis levels. By closing switch SW1', the discharge time of the capacitor becomes several times as fast as the rise time. A square wave S is generated and transmitted to the relay and can have a 10:1 mark space ratio.

It is understood that while certain forms of the present invention have been illustrated and described herein, it is not to be limited to the specific forms or arrangements of parts described and shown.

I claim:

1. A writing instrument comprising:

A) a housing having a writing tip end and a rear end;

B) a writing tip in said housing; and

C) vibrating means in said housing, said vibrating means including (1) a relay having an arm mounted to move cyclically between a first arm position abutting said housing and a second arm position spaced from said housing, (2) a relay control in said housing and connected to said relay and controlling movement of said arm, (3) power means in said housing and connected to said relay control, and (4) said relay control including a switch element and adjusting means for adjusting the cycle of said arm.

2. The writing instrument defined in claim 1 wherein said relay control further includes an op-amp, a Schmitt trigger and an integrator built around said op-amp.

3. The writing instrument defined in claim 2 wherein said relay control further includes an RC network connected to said op-amp.

4. The writing instrument defined in claim 3 wherein said RC network further includes an adjustable resistor.

5. The writing instrument defined in claim 4, wherein said adjustable resistor includes an adjustment means on said housing.

6. The writing instrument defined in claim 5 wherein said relay control further includes a power conversion circuit means.

7. The writing instrument defined in claim 6 wherein said power conversion circuit means includes two transistors.

8. The writing instrument defined in claim 7 wherein said housing further includes a ring element.

* * * * *